US007828281B2

(12) United States Patent
Terao et al.

(10) Patent No.: US 7,828,281 B2
(45) Date of Patent: Nov. 9, 2010

(54) SHEET POST-PROCESSING APPARATUS AND SHEET POST-PROCESSING METHOD

(75) Inventors: Yasunobu Terao, Izunokuni (JP); Mikio Yamamoto, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 308 days.

(21) Appl. No.: 12/042,480

(22) Filed: Mar. 5, 2008

(65) Prior Publication Data

US 2008/0315506 A1 Dec. 25, 2008

Related U.S. Application Data

(60) Provisional application No. 60/944,820, filed on Jun. 19, 2007, provisional application No. 60/944,824, filed on Jun. 19, 2007, provisional application No. 60/944,825, filed on Jun. 19, 2007.

(51) Int. Cl.
*B65H 29/46* (2006.01)

(52) U.S. Cl. ..... 271/84; 271/3.02; 271/271

(58) Field of Classification Search ..... 271/84, 271/213, 3.01–3.03, 189, 271; 270/58.11, 270/58.12, 58.01, 58.27, 58.07, 58.08, 59; 399/407–410; 414/790.3; 198/717, 721, 198/736, 738, 741, 747, 748

See application file for complete search history.

(56) References Cited

U.S. PATENT DOCUMENTS

| | | | | |
|---|---|---|---|---|
| 4,989,854 | A * | 2/1991 | McNamara | 271/213 |
| 5,623,722 | A * | 4/1997 | Hawley et al. | 399/397 |
| 5,957,652 | A * | 9/1999 | Mimura et al. | 414/790.4 |
| 7,510,070 | B2 * | 3/2009 | Rothbauer | 198/717 |
| 2002/0163119 | A1 * | 11/2002 | Kawata | 271/207 |
| 2006/0051147 | A1 * | 3/2006 | Sato et al. | 399/405 |
| 2006/0202403 | A1 * | 9/2006 | Nagata et al. | 270/58.11 |

FOREIGN PATENT DOCUMENTS

| | | |
|---|---|---|
| JP | 2003-026368 | 1/2003 |
| JP | 2003-212419 | 7/2003 |
| JP | 2004-284773 | 10/2004 |

* cited by examiner

*Primary Examiner*—Stefanos Karmis
*Assistant Examiner*—Jeremy Severson
(74) *Attorney, Agent, or Firm*—Turocy & Watson, LLP

(57) ABSTRACT

When a sheet is conveyed from a processing tray to a stacking tray, a bar-like pushing member is moved in a direction of the stacking tray in synchronization with an ejector. Consequently, simultaneously with the movement of the sheet by the ejector, a lower surface of a leading end of the sheet is pushed to relax and reduce a contact force between the lower surface of the leading end of the sheet and the stacking tray (or an upper surface of a sheet already stacked on the stacking tray). As a result, static friction at the leading end of the sheet is changed to dynamic friction and the entire sheet is conveyed to the stacking tray without bending.

16 Claims, 13 Drawing Sheets

SHEET POST-PROCESSING APPARATUS AND SHEET POST-PROCESSING METHOD

CROSS-REFERENCE TO RELATED APPLICATIONS

This application claims the benefit of U.S. Provisional Application No. 60/944,820, filed Jun. 19, 2007; No. 60/944,824, filed Jun. 19, 2007; and No. 60/944,825, filed Jun. 19, 2007.

BACKGROUND OF THE INVENTION

1. Field of the Invention

The present invention relates to a sheet post-processing apparatus with an improved mechanism for conveying a sheet from a processing tray to a stacking tray and a sheet post-processing method.

2. Description of the Related Art

In a sheet post-processing apparatus, a leading end of a sheet stacked on a processing tray is in contact with an upper surface of a stacking tray or an upper surface of sheets already stacked on the stacking tray. When the sheet stacked on the processing tray is conveyed to the stacking tray in this state, static friction occurs between the conveyed sheet and the upper surface of the stacking tray or the upper surface of the sheets already stacked on the stacking tray. A coefficient of static friction is larger than a coefficient of dynamic friction. Therefore, the leading end of the sheet in contact with the stacking tray hardly moves. On the other hand, other portions of the sheet easily move. As a result, the center of the sheet starts to bend upward (see FIGS. 15 and 16). When the sheet is fed to the stacking tray while bending upward, the sheet is stacked on the stacking tray in a nonaligned state. When stacked plural sheets are conveyed, a leading end of a sheet on a lower side hangs down (curves to the lower side) because the leading end of the sheet on the lower side is not supported by the processing tray. When the sheets are conveyed in this state, the sheets on the lower side among the plural stacked sheets are stacked on the stacking tray in a state in which the leading end side thereof is bent inward.

Japanese Patent Disclosure (Kokai) No. 2004-284773; Y. Takaishi et al.; Oct. 14, 2004 discloses a sheet discharging apparatus that can discharge, even when a swell, curl, or the like due to staples is present in a sheet 90 discharged onto a discharge tray 49, the sheet 90 onto the discharge tray 49 in a good posture. The sheet discharging apparatus includes a sheet tray 46 onto which sheets having images formed thereon are discharged in a stacked state and plural pressing members 55 that press a trailing end in a discharging direction of the sheets discharged onto the sheet tray 46. The plural pressing members 55 are arranged along a direction orthogonal to a discharging direction of the sheets and urged to individually press the sheets discharged onto the discharge tray 49.

BRIEF SUMMARY OF THE INVENTION

It is an object of the present invention to provide a sheet post-processing apparatus and a sheet post-processing method for preventing, when a sheet or stacked plural sheets are conveyed from a processing tray to a stacking tray, the sheet(s) from bending to thereby surely align and stack the sheet(s) on the stacking tray.

In order to attain this object, a sheet post-processing apparatus according to an aspect of the present invention is a sheet post-processing apparatus including:

a processing tray that aligns stacked one or plural sheets;

a stacking tray on which the sheet(s) aligned by the processing tray is stacked;

a conveying mechanism that conveys the sheet(s) aligned by the processing tray to the stacking tray;

a pushing member, a distal end of which is located at an end on the stacking tray side of the processing tray, the pushing member being arranged to allow the distal end to project in a direction of the stacking tray;

a pushing member driving mechanism that reciprocatingly drives the pushing member such that the distal end projects in the direction of the stacking tray and returns to the processing tray side after the projection; and a driving control mechanism that controls to drive the pushing member driving mechanism to perform a reciprocating operation for projecting, in a process of conveying the sheet(s) from the processing tray to the stacking tray with the conveying mechanism, the distal end of the pushing member to the stacking tray side to push a lower surface of the sheet(s) and returning the distal end to the processing tray side after the pushing.

A sheet post-processing method according to another aspect of the present invention is a sheet post-processing method including:

aligning stacked one or plural sheets with a processing tray;

conveying the aligned sheet(s) and stacking the sheet(s) on a stacking tray; and performing a reciprocating operation for projecting, in a process of conveying the sheet(s) from the processing tray to the stacking tray, a distal end of a pushing member to the stacking tray side to push a lower surface of the distal end of the sheet(s) and returning the distal end to the processing tray side after the pushing.

According to the sheet post-processing apparatus and the sheet post-processing method, even if a leading end of a sheet comes into contact with the stacking tray, since the leading end of the sheet is pushed by the pushing member to relax and reduce a contact force between the stacking tray and the leading end of the sheet, the sheet is prevented from bending during conveyance. Therefore, it is possible to appropriately convey even a thin sheet and stacked plural sheets to the stacking tray. When the sheet is pushed by the pushing members, conveyance of the sheet is supported. Therefore, directional properties in conveying the sheet to the stacking tray are stabilized and stacking alignment properties in the stacking tray are improved.

DETAILED DESCRIPTION OF THE INVENTION

Figure 1:
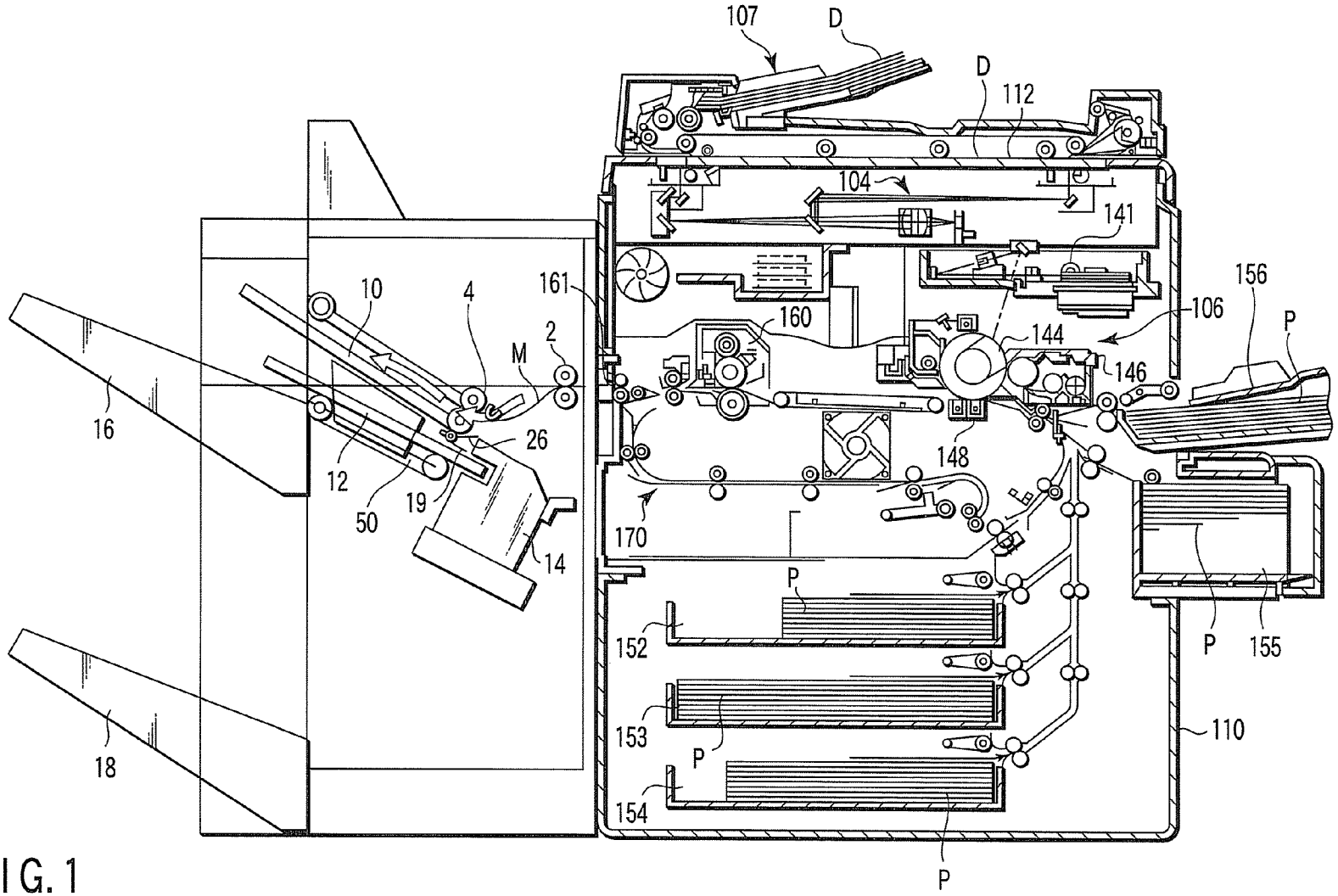
FIG. 1 is a schematic diagram of a digital copying machine (an image forming apparatus) and a post-processing apparatus according to an embodiment of the present invention connected to the image forming apparatus.

Embodiments of the present invention will be hereinafter explained in detail with reference to the accompanying drawings.

(Overview of an Image Forming Apparatus)

An overview of an image forming apparatus (a digital copying machine) and a post-processing apparatus according to an embodiment of the present invention arranged to be connected to a post-stage of the image forming apparatus are explained with reference to FIG. 1. In the image forming apparatus, an original placing stand 112 is provided on an upper surface thereof. An automatic document feeder 107 (hereinafter referred to as ADF) that automatically feeds an original D onto the original placing stand 112 is arranged on the original placing stand 112. After placing the original D on the ADF and performing predetermined setting (e.g., presence or absence of staple processing, a way of the staple processing, the number of copies, and a size of a sheet to be copied), a user presses a copy start switch. The original D on the ADF is conveyed to a predetermined position of the original placing stand 112.

A scanner unit 104, a printer unit 106, and cassettes 152, 153, 154, and 156 and a feeder 155 for copy sheets P are disposed inside the image forming apparatus. The scanner unit 104 scans the original D on the original placing stand 112, makes reflected light of the original D incident thereon, photoelectrically converts the incident reflected light to the read image information of the original D, and outputs a photoelectric signal corresponding to the read image information. The printer unit 106 forms an electrostatic latent image on a circumferential surface of a photoconductive drum 144 using a semiconductor laser 141 according to the image information and the like of the original D read by the scanner unit 104. A developing device 146 supplies a toner to the photoconductive drum 144 and visualizes the electrostatic latent image formed on the photoconductive drum 144 to form a toner image.

The copy sheets P are fed to the photoconductive drum 144 from the cassettes 152, 153, 154, and 156 and the feeder 155 for the copy sheets P. The toner image on the photoconductive drum 144 is copied onto each of the copy sheets P by a transfer charger 148. Thereafter, the toner image on the copy sheet P is fixed by a fixing device 160 and the copy sheet P is discharged from a discharge opening 161. The copy sheet P is equivalent to a sheet M according to the embodiment.

(Overview of the Post-Processing Apparatus)

The post-processing apparatus 1 arranged to be connected to the post stage of the digital copying machine includes a standby tray 10 that accumulates several sheets M fed through an entrance roller 2 and an exit roller 4 and puts the sheets M on standby, a processing tray 12 that receives the sheets M dropped from the standby tray 10 and aligns trailing ends of the sheets M for staple processing, a stapler (stapling means) 14 that subjects the trailing ends of the sheets M accumulated in the processing tray 12 and aligned to staple processing (binding processing), a conveying mechanism 50 that conveys the sheets M after being subjected to the staple processing, sort processing, and the like, and a stacking tray 16 (18) on which the conveyed sheets M are stacked.

When the sheets M in the processing tray 12 are subjected to the staple processing, the standby tray 10 puts sheets M, which are conveyed thereto and form the next sheet stack for subsequent post-processing, in a place separate from the processing tray 12 and temporarily keeps the sheets M in a standby state. In this manner, the processing tray 12 secures a time the stapler 14 requires for the staple processing. The standby tray 10, the processing tray 12, and the stacking tray 16 (18) are provided to incline downward to trailing ends in a feeding direction of the sheets M. A sheet guide 19 is arranged above the processing tray 12 to be spaced apart from the processing tray 12 and guides the sheets M fed to the processing tray 12. The stapler 14 is arranged at the trailing end in the feeding direction of the sheets M of the processing tray 12, stops the sheets M, which are placed on the processing tray 12, on the trailing end side, and performs the staple processing for the sheets M.

(Processing Tray)

Figure 2:
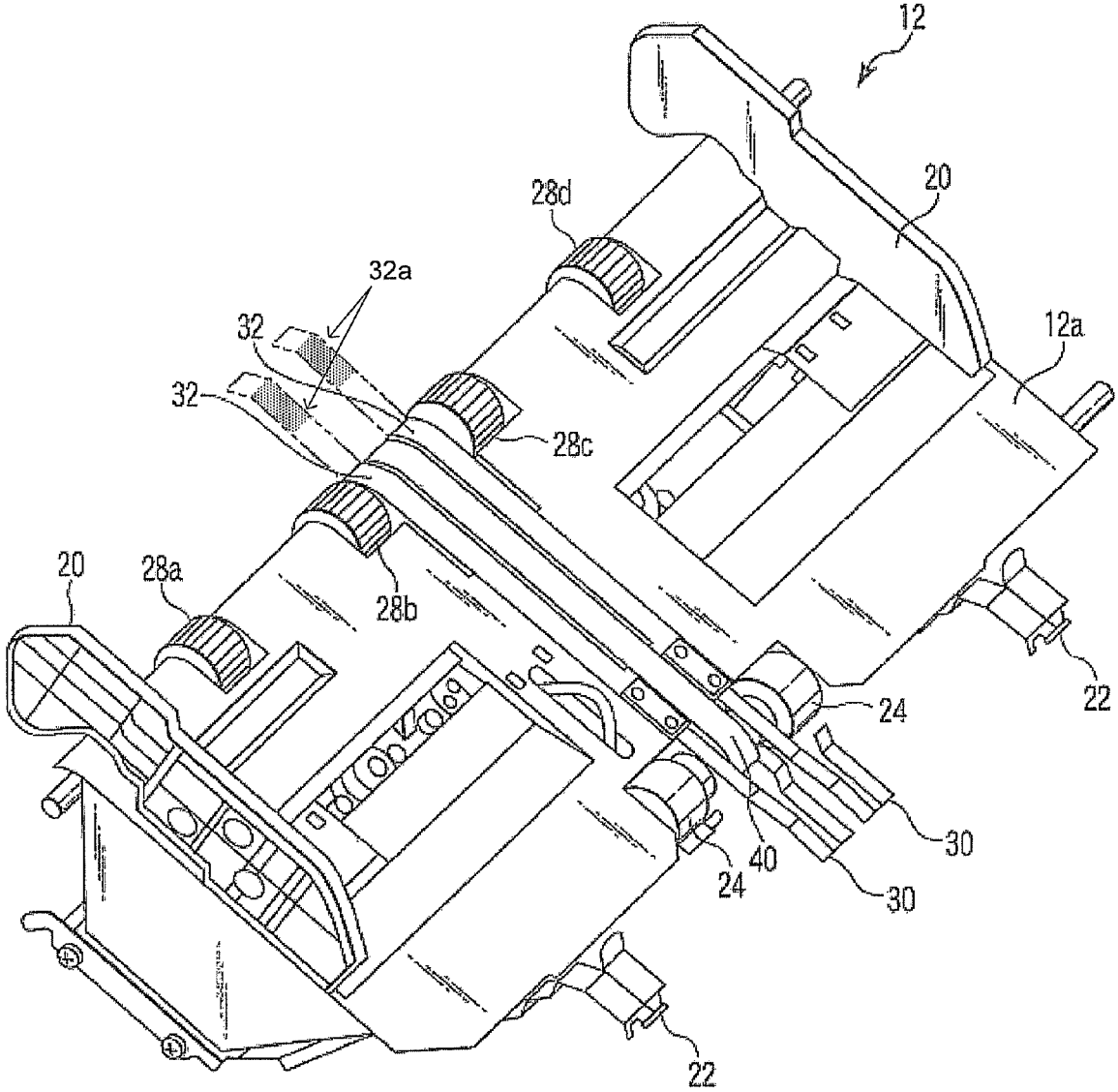
FIG. 2 is a diagram of a processing tray according to the embodiment viewed from obliquely above.

FIG. 2 is a diagram of the processing tray 12 viewed from obliquely above. The processing tray 12 has a flat sheet support surface 12*a* on which the sheets M dropped from the standby tray 10 are placed and accumulated. In the processing tray 12, horizontal alignment plates 20 for horizontally aligning the sheets M are provided on both sides in a width direction of the sheet support surface 12*a*. Further, in the processing tray 12, trailing end stoppers 22 are provided on a trailing end side in a conveying direction of the sheet support surface 12*a* to project from a trailing end surface of the sheet support surface 12*a*. Moreover, in the processing tray 12, vertical alignment rollers 24 are provided on the trailing end side in the conveying direction. A paddle 26 (shown in FIGS. 1, 15, 16, and 17) is provided on the trailing end side in the conveying direction above the processing tray 12. The sheets M received in the processing tray 12 are brought into contact with the trailing end stoppers 22 and vertically aligned by the paddle 26, the vertical alignment rollers 24, and discharge rollers 28*a*, 28*b*, 28*c*, and 28*d*.

Four discharge rollers 28*a*, 28*b*, 28*c*, and 28*d* in total are provided on a leading end side in the conveying direction of the sheet support surface 12*a* of the processing tray 12. Two of the discharge rollers are provided in the center and the other two are provided on both sides of the sheet support surface 12*a*, respectively. These discharge rollers are driven to rotate to convey the sheets M to the stacking tray 16 (18).

In the center on the trailing end side of the sheet support surface 12*a* of the processing tray 12, ejectors 30 are provided to project from the trailing end surface of the processing tray 12. In the center on the leading end side of the sheet support surface 12*a* of the processing tray 12, bar-like pushing members 32 are arranged. Distal end portions of the pushing members are located between the discharge rollers 28*c* and 28*d* in the center. The pushing members 32 are made of, for example, an elastic plate material or a composite member formed by laminating an elastic plate material and a plastic plate material and are integrally attached to the ejectors 30, respectively.

The pushing members 32 are formed of flexible plastic that can be elastically deformed even by a touch of a hand. Frictional members 32*a*, 32*a* (e.g., rubber) are provided on distal end upper surfaces thereof. The pushing members 32 do not usually project from the processing tray 12 and are in positions further retracted than the discharge rollers 28*a*, 28*b*, 28*c*, and 28*d*. Therefore, the pushing members 32 do not come into contact with the sheet M. When the pushing members 32 project from the leading end side in the conveying direction of the sheet support surface 12*a* of the processing tray 12, the frictional members 32*a*, 32*a* on the leading end upper surfaces come into contact with the lower surface of the sheet M and push up the lower surface of the sheet M.

Figure 3:
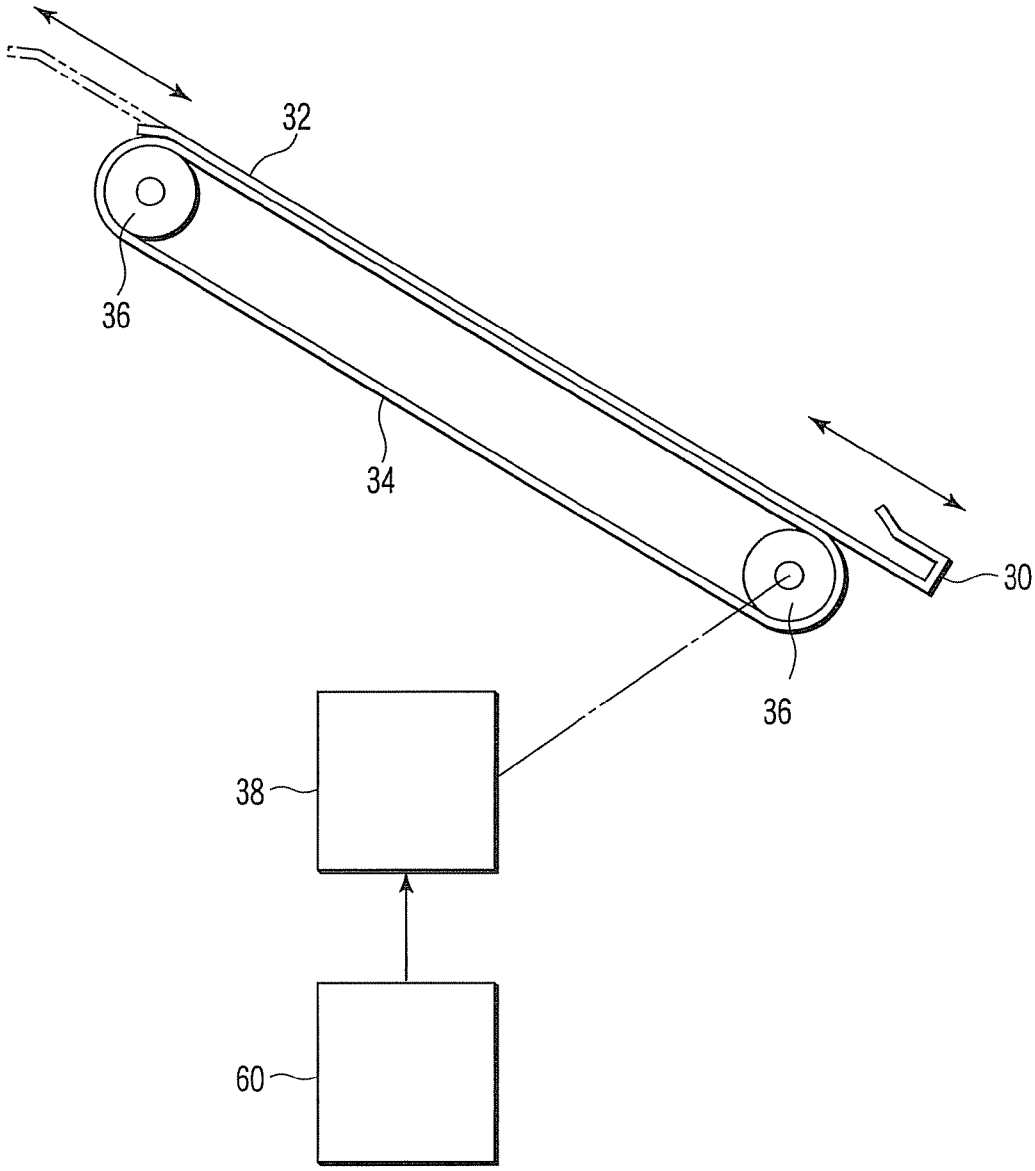
FIG. 3 is a diagram for explaining an ejector and a bar-like pushing member in the processing tray and members related to these members.

The ejectors 30 and the pushing members 32 integrally attached to the ejectors 30 are driven by an identical motor to perform a reciprocating action of moving in the direction of the stacking tray 16 and returning from the movement. The ejectors 30 and the pushing members 32 move at the same timing and in the same distance. FIG. 3 shows the elector 30, the pushing member 32, a belt 34 that supports the ejector 30 and the pushing member 32, pulleys 36 around which the belt 34 is wound, and a motor 38 that drives the pulleys 36. Driving control of the motor 38 is performed by a driving control mechanism 60 described later. Driving of the pushing member 32 can be performed not only by the motor 38 but also by a solenoid (a rotary solenoid).

Figure 4:
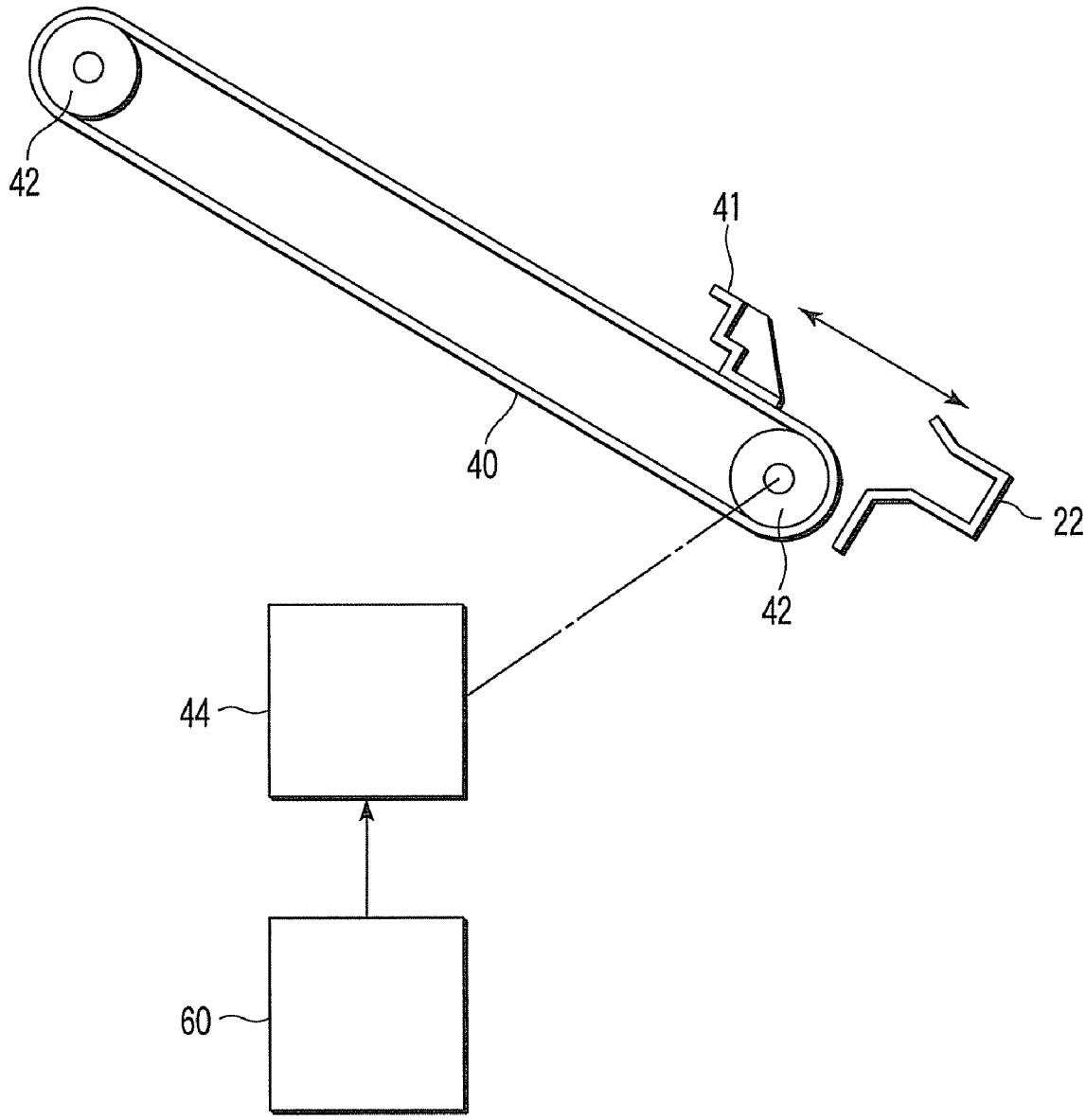
FIG. 4 is a diagram for explaining a bundle claw belt in the post-processing apparatus and members related to the bundle claw belt.

A bundle claw belt 40 is arranged between a pair of ejectors 30 and between a pair of pushing members 32. As shown in FIG. 4, the bundle claw belt 40 is attached with a bundle claw 41 and wound between the pulleys 42. An upper surface of the bundle claw belt 40 moves in a sheet conveying direction. The pulleys 42 are driven by a motor 44. Driving control of the motor 44 is performed by the driving control mechanism 60 described later.

Figure 5:
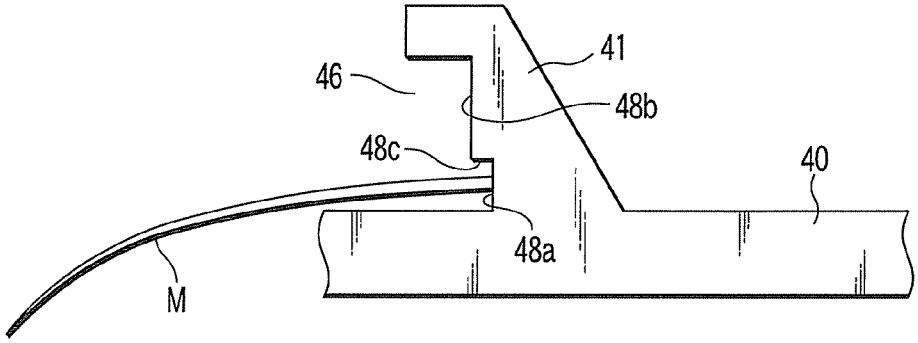
FIG. 5 is a diagram showing a form of a bundle claw for conveying a sheet bundle stacked on the processing tray to a stacking tray.

In the bundle claw 41 attached to the bundle claw belt 40, as shown in FIG. 5, a concave portion 46 for regulating a position of a sheet trailing end is formed. The concave portion 46 has a bottom surface with which the sheet trailing end comes into contact. In the bottom surface, a surface 48*a* on a lower side that is in contact with the bundle claw belt 40 is formed to be depressed deeper than a surface 48*b* on an upper side. A step portion 48*c* is formed between the surface 48*a* on the lower side and the surface 48*b* on the upper side.

Figure 6:
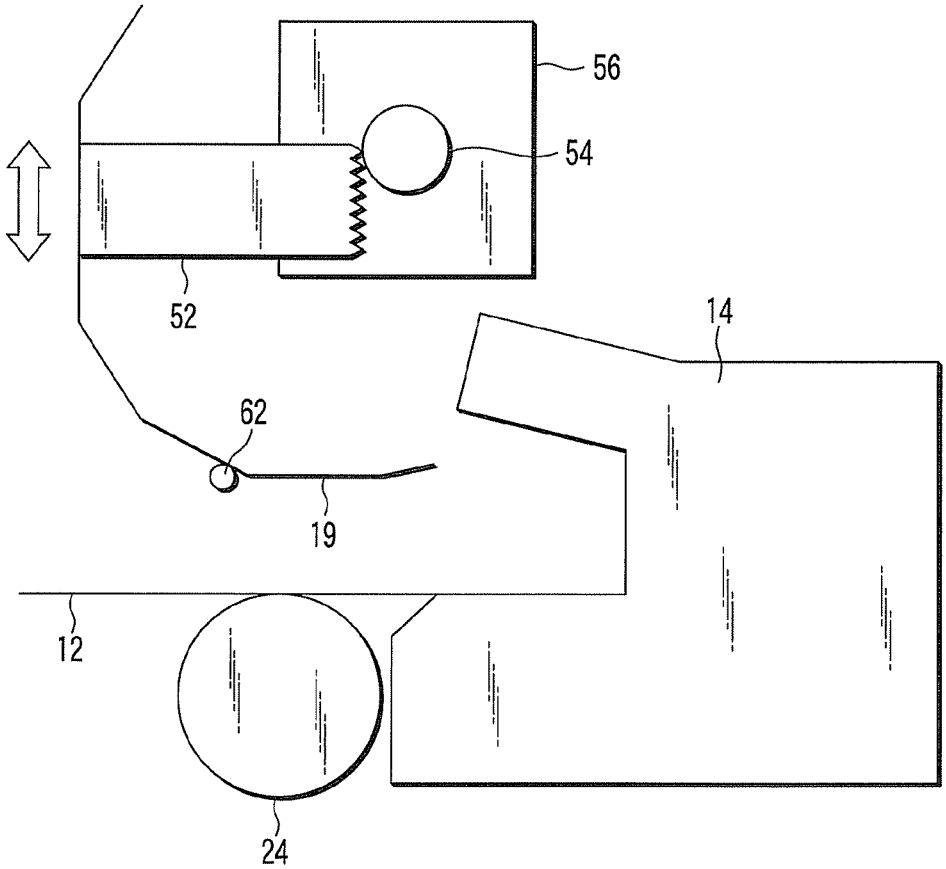
FIG. 6 is an enlarged schematic diagram of a sheet guide of the post-processing apparatus and a driving mechanism therefore.

FIG. 6 is a schematic diagram for explaining, in particular, the sheet guide 19 and members related to thereto in the processing tray 12. The sheet guide 19 formed of a metal plate material, a resin molding, or the like is provided above the processing tray 12. A rack 52 is attached to the sheet guide 19. The rack 52 meshes with a pinion 54, which is driven by a motor 56. Therefore, when the motor 56 is driven, the sheet guide 19 moves in a direction away from the processing tray 12 or a direction toward the processing tray 12. The motor 56 is controlled by the driving control mechanism 60.

(Driving Control)

Figure 7:
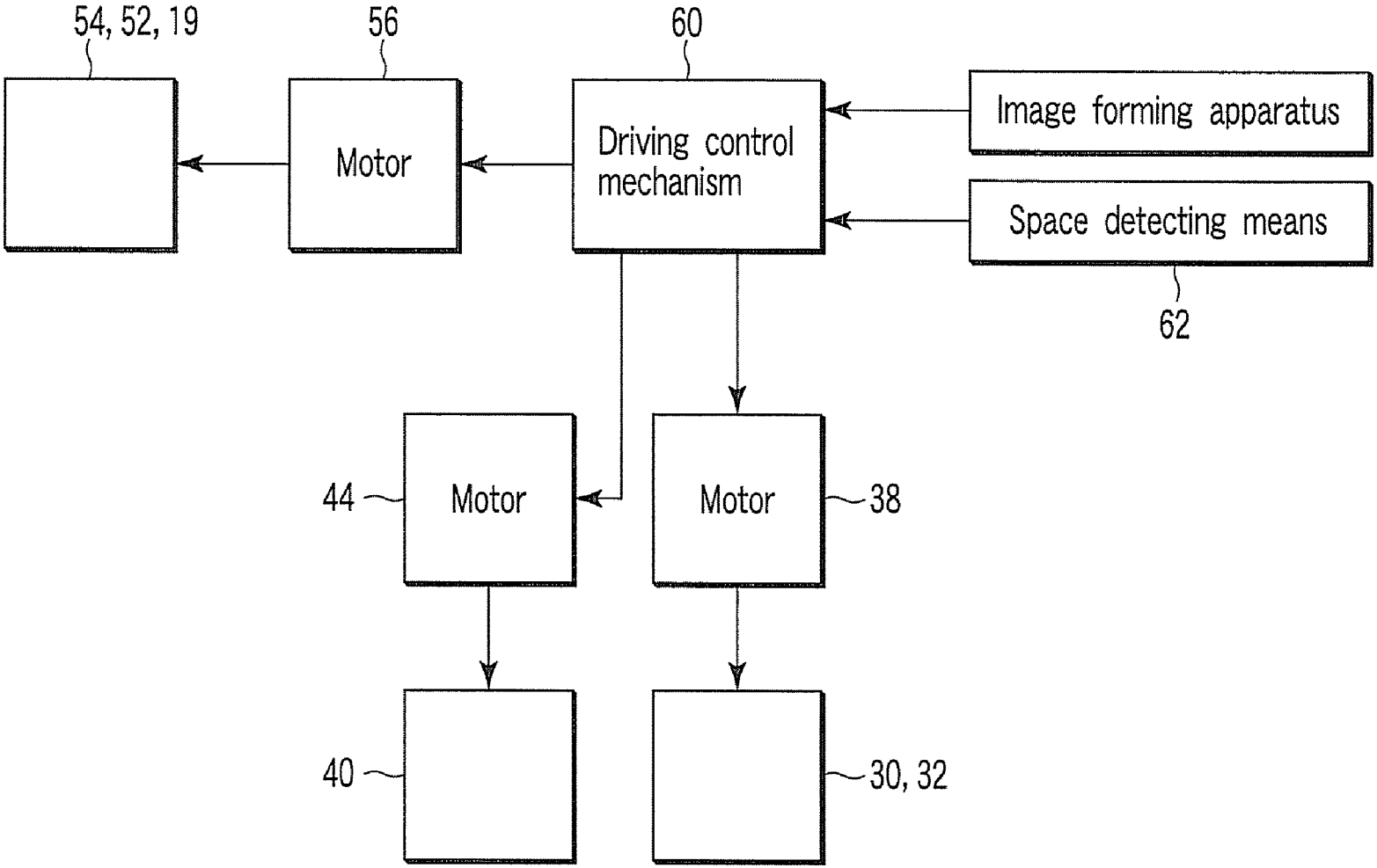
FIG. 7 is a diagram for explaining a driving control mechanism.

In the image forming apparatus, as described above, the predetermined setting (e.g., setting of presence or absence of staple processing, a way of the staple processing, the number of copies, and a size of a sheet to be copied) is performed. Therefore, as shown in FIG. 7, the driving control mechanism 60 is inputted with information concerning any one of the number of sheets and the thickness of the sheets or both from the image forming apparatus and controls the driving of the motor 56 on the basis of a signal of this input and the number of sheets stacked on the processing tray 12. Alternatively, the driving control mechanism 60 detects, using space detecting means 62 (shown in FIG. 6) mounted on the processing tray 12, a space between a ceiling surface of the sheet guide 19 and an upper surface of sheets stacked on the processing tray 12 (when sheets are not stacked, an upper surface of the processing tray 12) (equivalent to the thickness of stacked sheets) and controls the driving of the motor 56 on the basis of a value of this detection. The driving of the motor 56 may be continuously performed every time sheets are increased or may be intermittently performed to reduce the space between the sheet guide 19 and the upper surface of sheets to be equal to or smaller than about 7 mm when a space between the sheet M and the sheet guide 19 is reduced by some degree. When aligned sheets are fed to the stacking tray 16 and it is detected that the sheets M are not stacked on the processing tray 12, the driving control mechanism 60 drives the motor 56 and resets the sheet guide 19 to an initially set position. In this position, a space small enough for preventing human fingers from entering is provided between the processing tray 12 and the sheet guide 19. It is possible to guide a small number of sheets.

In conveying a sheet stacked on the processing tray 12 to the stacking tray 16, the driving control mechanism 60 performs control of the driving motor 38 that drives the ejector 30 and the pushing member 32, the motor 44 that drives the bundle claw belt 40, and the like. For example, when staple processing in the stapler 14 is finished, the driving control mechanism 60 sends a driving signal to the motor 38, moves the ejector 30 and the pushing member 32 in the direction of the stacking tray 16, and, after moving the ejector 30 and the pushing member 32 by a predetermined stroke, returns the same to original positions thereof. The driving control mechanism 60 sends a driving signal to the motor 44 at appropriate timing and moves the bundle claw 41 of the bundle claw belt 40 in the direction of the stacking tray 16.

The appropriate timing is timing when a trailing end of the sheet fed by the ejector 30 can be received by the bundle claw 41.

Other Embodiments

Figure 8:
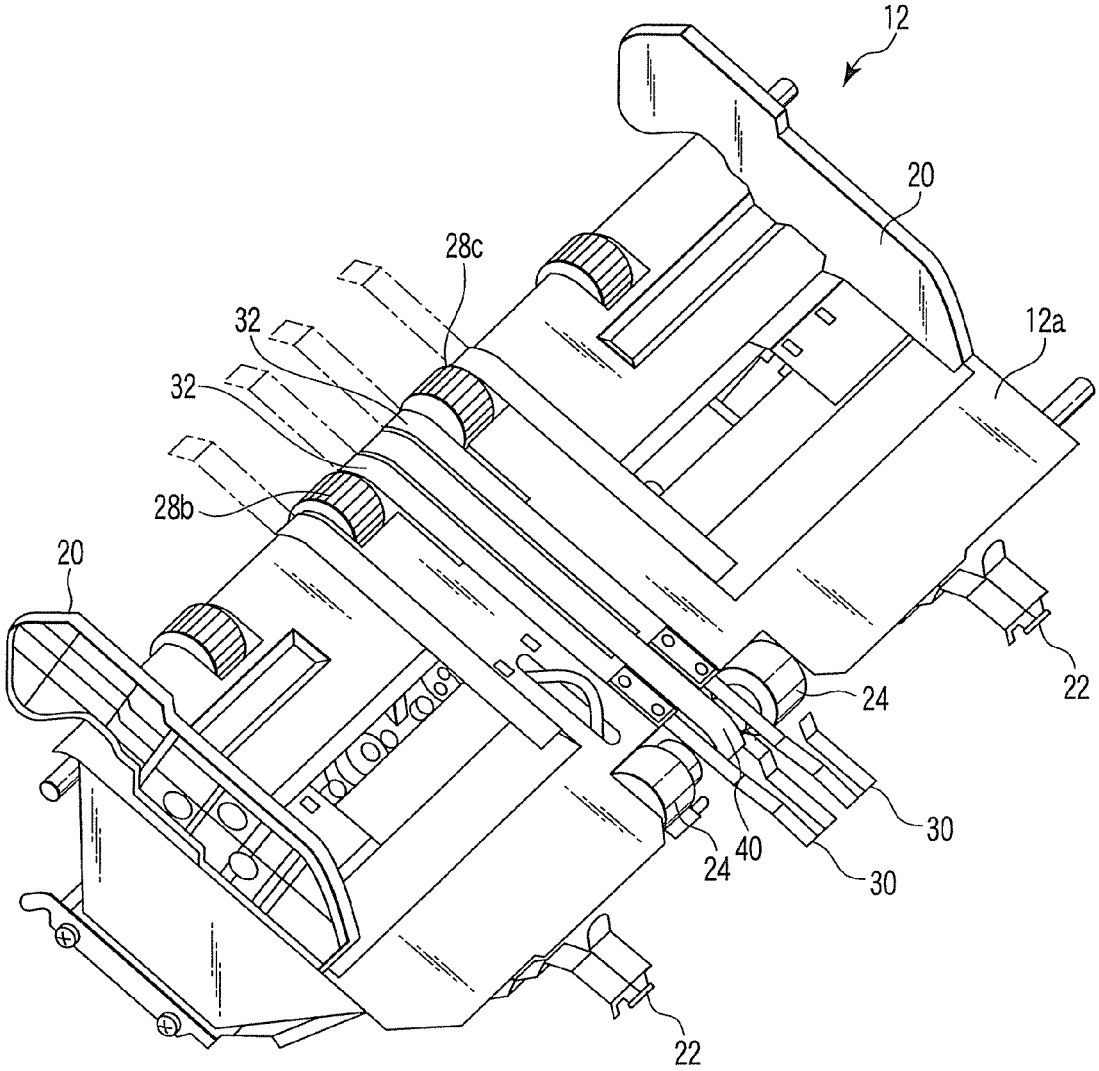
FIG. 8 is a diagram of a processing tray according to another embodiment of the present invention viewed from obliquely above.

In the example shown in FIG. 2, the pair of pushing members 32 are provided on outer sides of the bundle claw belt 40 provided between the discharge rollers 28*c* and 28*d* in the center. However, the present invention is not limited to this. For example, as shown in FIG. 8, another pair of pushing members may be provided on outer sides of the discharge rollers 28*c* and 28*d* in the center together with the pushing members 32 in FIG. 2 to arrange two pairs of pushing materials in total. In the structure shown in FIG. 8, the added pushing members are not attached to the ejectors 30. The added pushing members may reciprocatingly move in synchronization with the ejectors 30 shown in FIG. 2 or may reciprocatingly move at timing shifted from that of the ejectors 30 shown in FIG. 2. A range in which the added pushing members move may be the same as or different from a range in which the pushing members 32 shown in FIG. 2 move. A driving source of the added pushing members may be the same as or different from a driving source of the ejectors 30 shown in FIG. 2.

Figure 9:
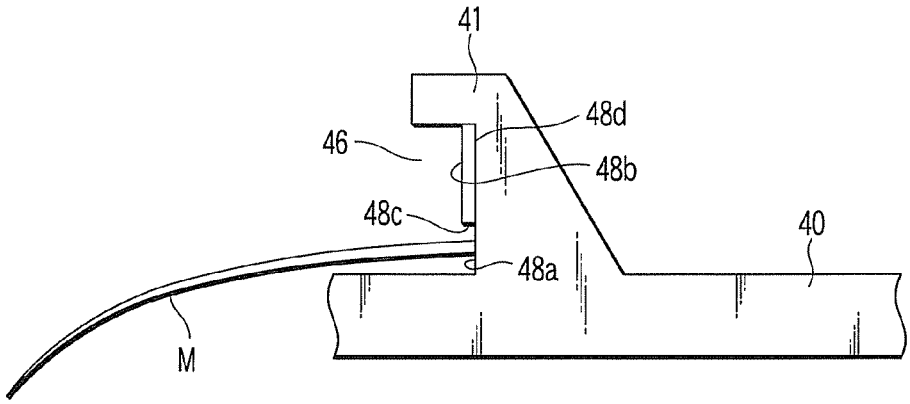
FIG. 9 is a diagram showing another form of the bundle claw for conveying a sheet bundle stacked on the processing tray to the stacking tray.

In FIG. 5, the concave portion 46 of the bundle claw 41 is integrally formed. However, the present invention is not limited to this. For example, as shown in FIG. 9, a member 48*d* having predetermined thickness may be stuck to a surface on an upper side of the concave portion 46 to form the step portion 48*c* between the surface 48*a* on the lower side and the surface 48*b* on the upper side. In this case, the bundle claw 41 can be manufactured by directly using a bundle claw having a flat bottom surface publicly-known in the past.

Figure 10:
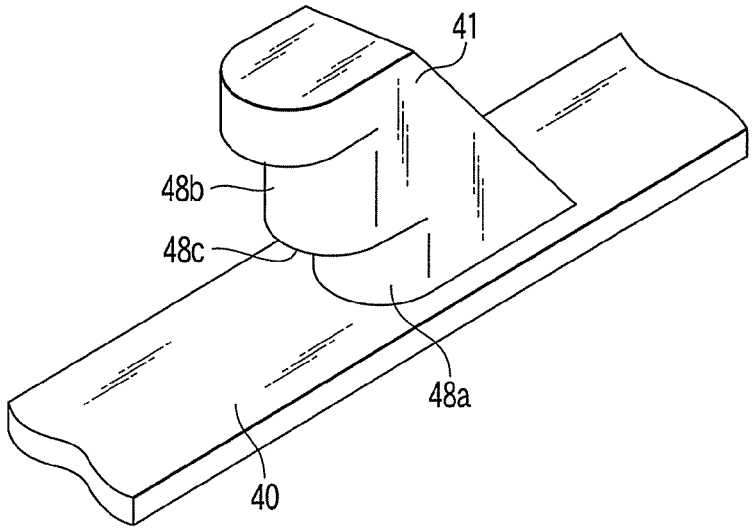
FIG. 10 is a diagram showing still another form of bundle claw for conveying a sheet bundle stacked on the processing tray to the stacking tray.

In the bundle claw 41 shown in FIGS. 5 and 9, both the surface 48*a* on the lower side and the surface 48*b* on the upper side are planes. However, as shown in FIG. 10, these surfaces can be surfaces bent convexly. With this bundle claw, even when a sheet tilts in a plan view with respect to a conveying direction thereof (i.e., when a trailing end surface of the sheet is not set at an angle of 90° with respect to the conveying direction), it is possible to surely regulate a position of the sheet trailing end.

(Explanation of Operations)

(Staple Mode)

Operations of the post-processing apparatus at the time of a staple mode are explained.

The sheet M is fed from the image forming apparatus to the post-processing apparatus (see an arrow direction in FIG. 1). The post-processing apparatus receives the sheet M in the entrance roller 2 and conveys the sheet M to the exit roller 4. When the sheets M exist in the processing tray 12, the post-processing apparatus temporarily stores the sheet M conveyed from the exit roller 4 in the standby tray 10. Subsequently, the post-processing apparatus opens the standby tray 10 and drops and supplies the stored sheet M to the processing tray 12. When the sheets M do not exist in the processing tray 12, the post-processing apparatus drops and supplies the sheet M to the processing tray without temporarily storing the sheet M in the standby tray 10. The processing tray 12 horizontally aligns the sheet M using the horizontal alignment plates 20 and bumps a trailing end of the sheet M against the trailing end stoppers 22 and vertically aligns the sheet M using the paddle 26 and the vertical alignment rollers 24. In this way, the sheet M is vertically and horizontally aligned by the processing tray 12 and guided by the sheet guide 19 and the processing tray 12. The sheet trailing end is guided into the stapler 14. The operation is sequentially applied to the sheets M fed one after another to guide the respective sheets M into the stapler 14.

The sheet guide 19 is initially set at a space with which sheets up to a specified number of sheets, for example, about fifty sheets (about 7 mm thick) can be guided.

Figure 11:
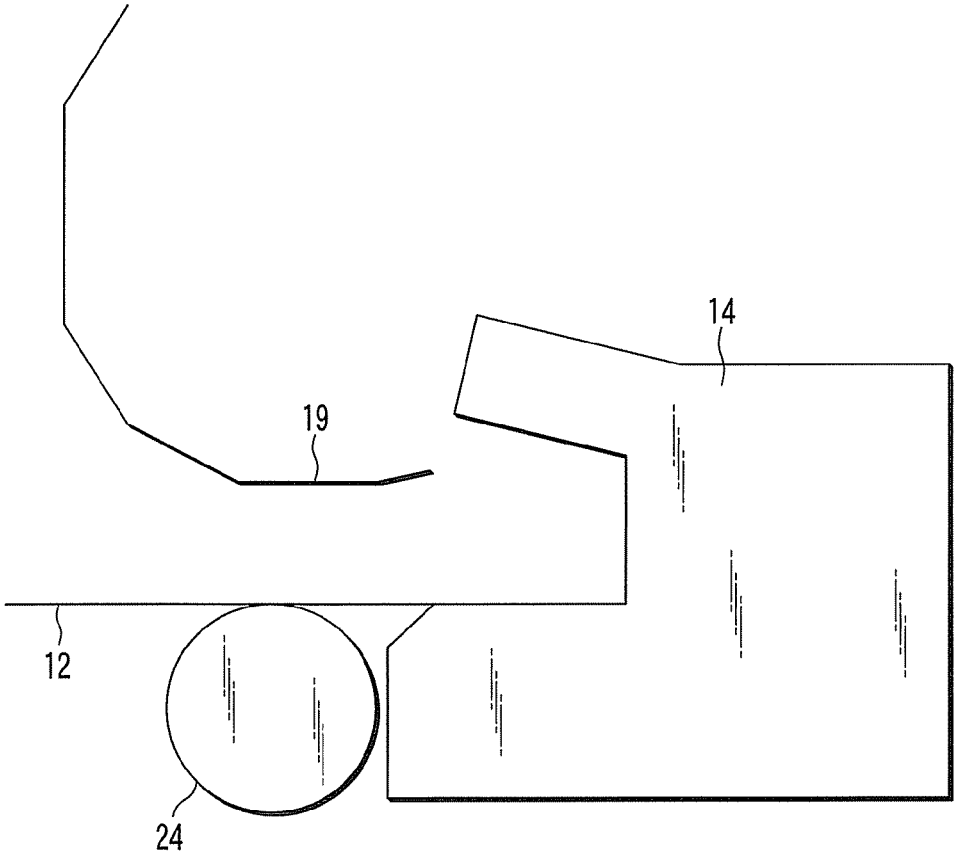
FIG. 11 is a diagram for explaining actions of the sheet guide and the driving mechanism therefore and shows a state in which no sheet is stacked on the processing tray.
Figure 12:
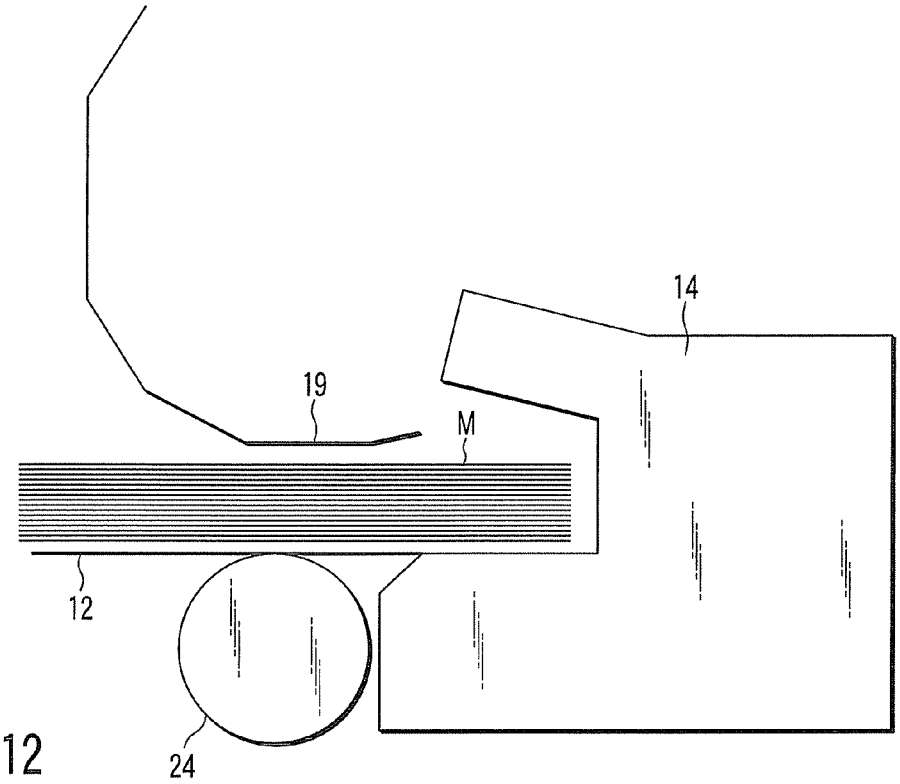
FIG. 12 is a diagram for explaining actions of the sheet guide and the driving mechanism therefore and shows a state in which sheets are stacked on the processing tray (about fifty sheets with the thickness of about 7 mm)

FIG. 11 shows a state in which no sheet is stacked on the processing tray 12. FIG. 12 shows a state in which the specified number of sheets M, e.g., about fifty sheets (about 7 mm thick) are stacked on the processing tray 12.

Figure 13:
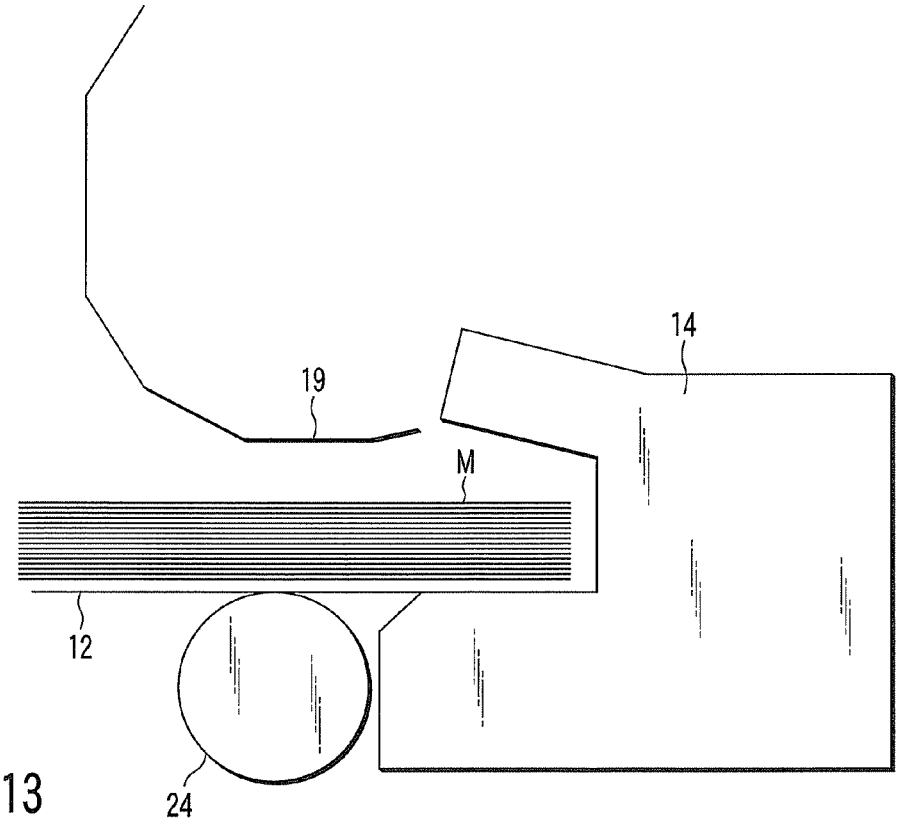
FIG. 13 is a diagram for explaining actions of the sheet guide and the driving mechanism therefore and shows a state in which sheets are stacked on the processing tray and the sheet guide is moved upward (about fifty sheets; about 7 mm thick)

When sheets M are increased and exceed the specified number, the sheet guide 19 is moved upward to increase the space between the sheet guide 19 and the processing tray 12. FIG. 13 shows a state in which the sheet guide 19 is moved upward to increase the space and can guide up to about one-hundred sheets.

Figure 14:
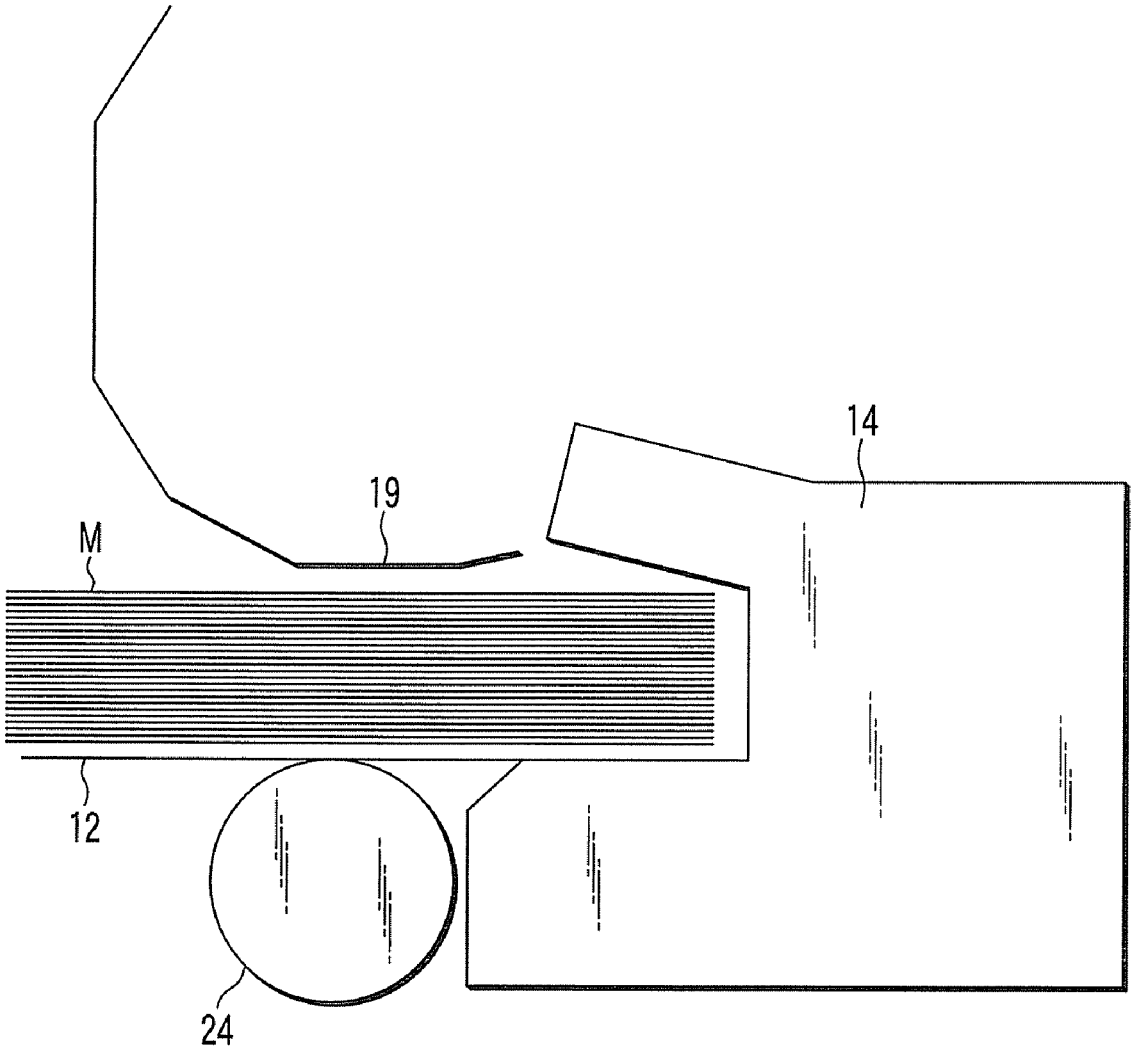
FIG. 14 is a diagram for explaining actions of the sheet guide and the driving mechanism therefore and shows a state in which sheets are further stacked on the processing tray (about 100 sheets) after the sheet guide is moved upward.
Figure 15:
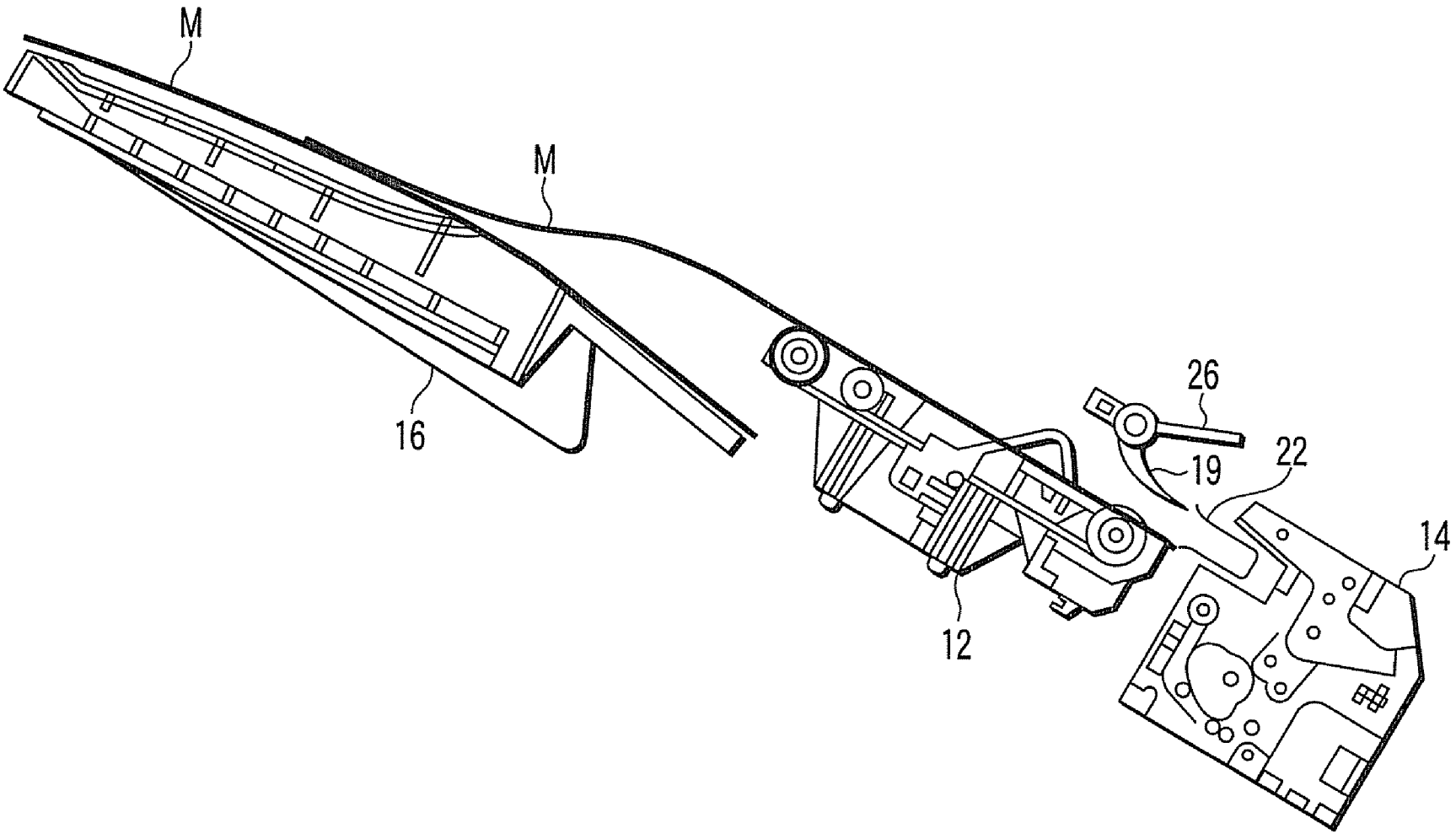
FIG. 15 shows a process of conveying a sheet stacked on the processing tray to the stacking tray using a conveying mechanism according to the embodiment and shows a state before a lower surface of a leading end of the sheet is pushed by pushing members.
Figure 16:
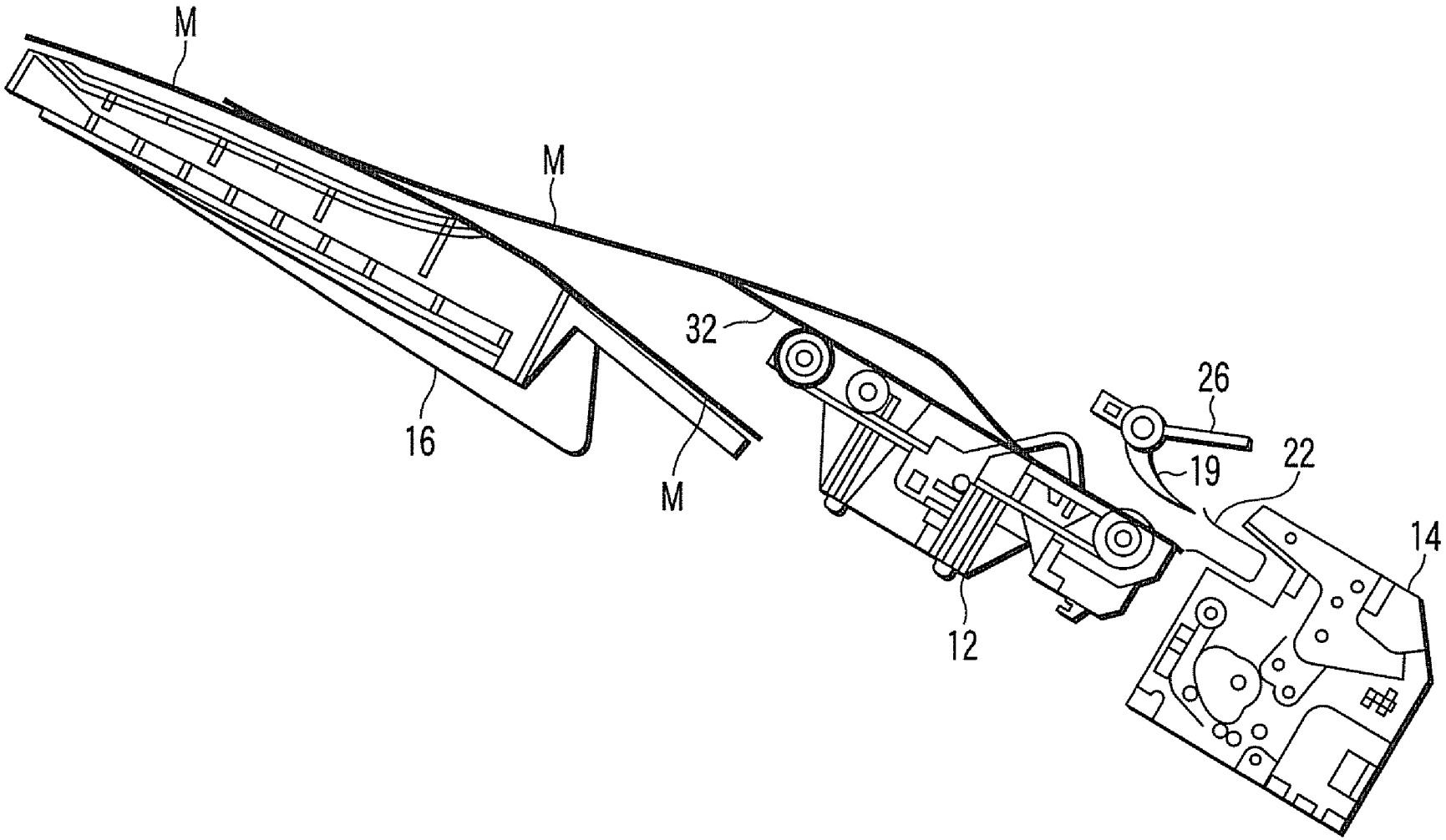
FIG. 16 shows a process of conveying a sheet stacked on the processing tray to the stacking tray using the conveying mechanism according to the embodiment and shows a state in which the lower surface of the leading end of the sheet is pushed by the pushing members.
Figure 17:
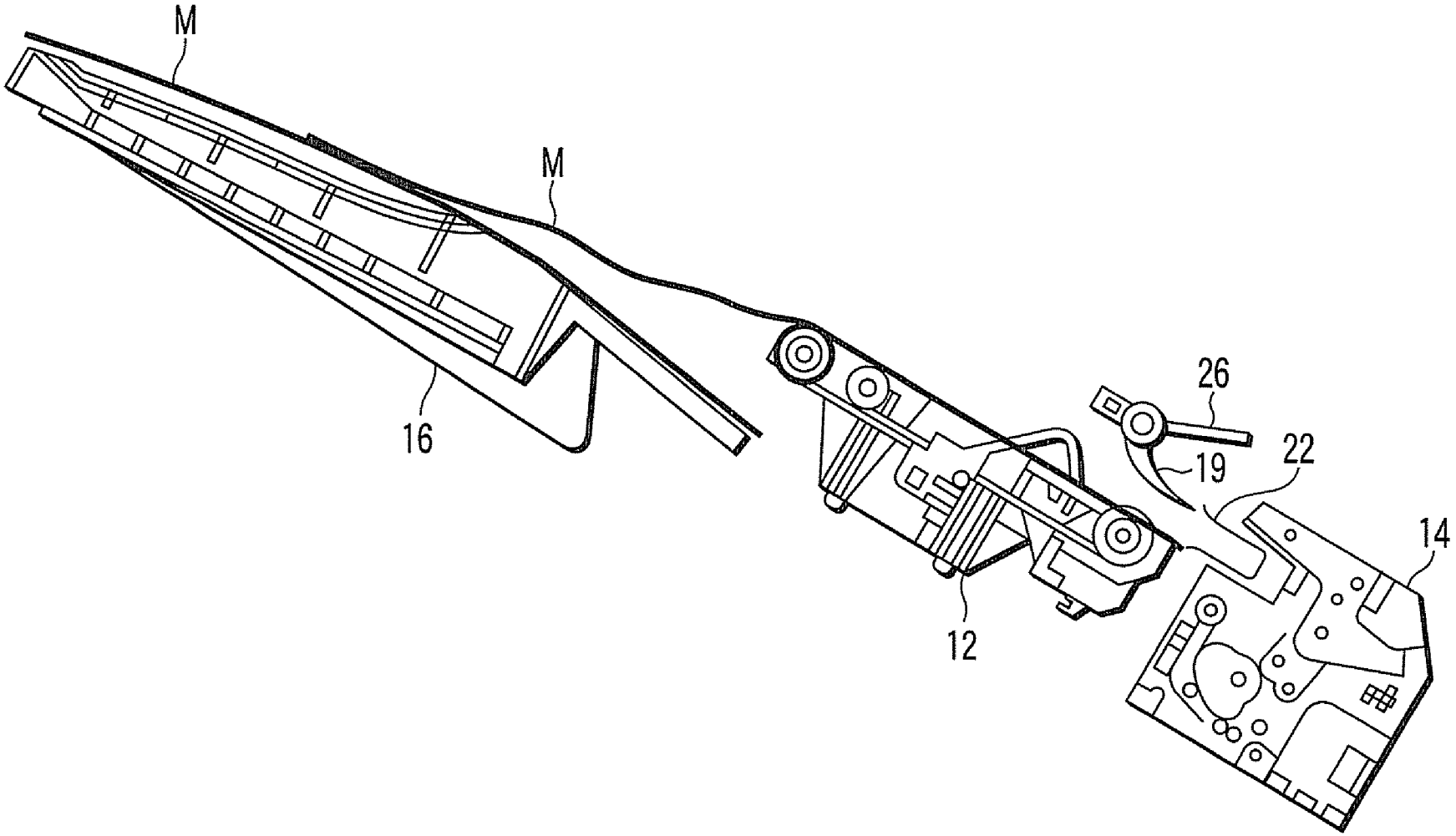
FIG. 17 shows a process of conveying a sheet stacked on the processing tray to the stacking tray using the conveying mechanism according to the embodiment and shows a state after the lower surface of the leading end of the sheet is pushed by the pushing members.

FIG. 14 shows a state in which a sheet M of a last page (e.g., one-hundredth sheet) is stacked on the processing tray 12. After aligning the last page (e.g., one-hundredth sheet), the sheets M are stapled by the stapler 14.

A stapled sheet bundle is pushed out by the ejector 10 and passed to the bundle claw 41 of the bundle claw belt 40. The bundle claw 41 discharges the sheets M to the stacking tray 16 in cooperation with the discharge rollers 28*a*, 28*b*, 28*c*, and 28*d*.

(Sort Mode)

Operations of the post-processing apparatus at the time of a sort mode are explained.

The sheet M is fed from the image forming apparatus to the post-processing apparatus (see the arrow direction in FIG. 1). The post-processing apparatus receives the sheet M in the entrance roller 2 and conveys the sheet M to the exit roller 4. The post-processing apparatus temporarily stores the sheet M conveyed from the exit roller 4 in the standby tray 10. Subsequently, the post-processing apparatus opens the standby tray 10 and drops and supplies the stored sheet M to the processing tray 12. The sheet guide 19 and the processing tray 12 guide the sheet M and guide the trailing end of the sheet M into the stapler 14. The processing tray 12 bumps the trailing end of the sheet M against the trailing end stoppers 22 using the paddle 26, the horizontal alignment plates 20, and the vertical alignment rollers 24 and sorts the sheet M using the horizontal alignment plates 20 simultaneously with the alignment (e.g., shifts the sheet M by 15 mm). The sheet M is pushed out by the ejectors 30 and passed to the bundle claw 41 of the bundle claw belt 40. The bundle claw 41 discharges the sheets M to the stacking tray 16 in cooperation with the discharge rollers 28*a*, 28*b*, 28*c*, and 28*d*.

In the case of sort, the number of sheets to be discharged (the number of sheets stacked on the processing tray 12) is divided into small numbers of sheets (about one to four sheets).

With the post-processing apparatus, it is possible to set a guide space according to sheet thickness and it is unlikely that human fingers enter the stapler by mistake. If there is information concerning the thickness of sheets, it is possible to control the space by detecting the number of sheets to be conveyed. Moreover, when a smaller number of sheets are processed, it is unnecessary to move the sheet guide 19 up and down while keeping the space set small. Therefore, it is possible to perform processing safely, at high speed, and with controlled noise occurrence.

(Sheet Conveyance)

In order to realize the compact structure of the post-processing apparatus, the processing tray 12 and the stacking tray 16 are arranged close to each other. Therefore, the leading end of the sheet M stacked on the processing tray 12 is in contact with the stacking tray 16 (see FIG. 15).

When the sheet M is conveyed from the processing tray 12 to the stacking tray 16, first, the ejectors 30 are driven and moved in the direction of the stacking tray 16. Although a position of the trailing end of the sheet M is regulated by the trailing end stoppers 22, the trailing end of the sheet M is caught by the ejectors 30 to move the sheet M in the direction of the stacking tray 16. At this point, the leading end of the sheet M is in contact with the upper surface of the stacking tray 16 or an upper surface of sheets already stacked on the stacking tray 16 and static friction occurs between the sheet and the stacking tray 16. Since a coefficient of static friction is larger than a coefficient of dynamic friction, the leading end of the sheet M in contact with the stacking tray 16 hardly moves. On the other hand, other portions of the sheet M move. As a result, the center of the sheet M starts to bend upward (see FIGS. 15 and 16).

In the post-processing apparatus, the pushing members 32 move in the direction of the stacking tray 16 in synchronization with the ejectors 30. Therefore, simultaneously with the movement of the sheet M by the ejectors 30, a lower surface of the leading end of the sheet M is pushed to relax and reduce a contact force between the lower surface of the leading end of the sheet M and the stacking tray 16 (or the upper surface of the sheets already stacked on the stacking tray 16). As a result, static friction at the leading end of the sheet M is changed to dynamic friction and the entire sheet is conveyed to the stacking tray 16 without curling (see FIGS. 16 and 17). The sheet M is aligned and stacked on the stacking tray 16.

If the lower surface of the leading end of the sheet M is not pushed by the pushing members 32, since the sheet M is fed to the stacking tray 16 while bending upward, the sheet M is stacked on the stacking tray 16 in a nonaligned state. When stacked plural sheets are conveyed, a leading end of sheets on a lower side hang down (curl to the lower side) unless the leading end is supported by the processing tray 12. When the sheets are conveyed in this state, the sheets on the lower side among the plural sheets are stacked on the stacking tray 16 in a state in which the leading end side thereof is bent inward. With the post-processing apparatus, it is possible to prevent such an unfavorable stacking state.

When the sheets are aligned, the pushing members 32 are located lower than the discharge rollers and do not come into contact with the sheets. After the lower surface of the leading end of the sheets is pushed, since the pushing members 32 return to original positions thereof (positions lower than the discharge rollers), when the sheets are conveyed by the bundle claw 41, the pushing members 32 do not come into contact with the sheets. Therefore, the sheets can be discharged to the stacking tray 16 without a trailing end of the sheet bundle being caught by the pushing members 32.

As described above, with the post-processing apparatus, even if the leading end of the sheet M comes into contact with the stacking tray 16, since the leading end of the sheet M is pushed by the pushing members 32 to relax and reduce a contact force between the stacking tray 16 and the leading end of the sheet, it is possible to prevent the sheet M from bending during conveyance. Therefore, it is possible to appropriately convey even a shin sheet and stacked plural sheets to the stacking tray 16. When the sheet M is pushed by the pushing members 32, conveyance of the sheet M is supported. Therefore, directional properties in conveying the sheet M to the stacking tray 16 are stabilized and stacking alignment properties in the stacking tray 16 are improved.

Further, by integrating the pushing members 32 with the ejectors 30, it is possible to reduce component cost, provide a common driving source for reciprocating movements of the pushing members 32 and the ejectors 30, and reduce sources of occurrence of noise.

Actions of the bundle claw belt 40 in feeding the sheet M to the stacking tray 16 are explained.

The ejectors 30 push the trailing end of the sheet M in the direction of the stacking tray 16 in a predetermined range. The sheet M pushed out a predetermined distance by the ejectors 30 is passed to the bundle claw 41 attached to the bundle claw belt 40. When the number of sheets is small, the trailing end of the sheets comes into contact with the surface 48*a* on the lower side of the bundle claw 41 (see FIGS. 5 and 9) and movement of the sheets to the surface on the upper side is regulated by the step portion 48*c*. As a result, it is possible to fix conveying speed of the sheets and control fluctuation in a conveying distance to thereby align and stack the sheets on the stacking tray 16.

Usually, the height of the bundle claw 41 is set large to make it possible to discharge a stapled bundle of one-hundred or more sheets. However, if the bottom surface of the concave portion 46 that regulates the trailing end of the sheet M is flat, in the case of a small number of sheets, the trailing end of the sheets cannot be fixed to a position on the lower surface side of the concave surface of the bundle claw 41 and slides to the upper surface side. The bundle claw belt 40 moves in the direction of the stacking tray 16 on the processing tray 12. However, at a point when the trailing end of the sheets is discharged from the bundle claw belt 40, the bundle claw belt 40 rotates. At this point, if the trailing end of the sheets is located on the lower surface side of the concave surface of the bundle claw 41, where the trailing end of the sheets should be originally located, since the position is a position close to a rotation center of the bundle claw belt 40, speed of discharging the sheets does not change. However, when the trailing end of the sheets moves to the upper surface side of the concave surface of the bundle claw 41, since the trailing end of the sheets is located apart from the rotation center, speed of discharging the sheets increases. As a result, discharge speed fluctuates and the sheets are stacked on the stacking tray 16 in a nonaligned state.

In the post-processing apparatus, when a small number of sheets are discharged from the processing tray 12 to the stacking tray 16, the trailing end of the sheets is located on the lower surface side of the concave surface of the bundle claw 41, where the trailing end of the sheets should be originally located, and does not move to the upper surface side of the concave surface of the bundle claw 41. As a result, fluctuation in discharge speed of the sheets is reduced and it is possible to stably discharge the sheets.

What is claimed is:

1. A sheet post-processing apparatus comprising:

a processing tray that aligns stacked one or plural sheets;

a stacking tray on which the sheet(s) aligned by the processing tray is stacked;

a conveying mechanism that conveys the sheet(s) aligned by the processing tray to the stacking tray;

a pushing member, a distal end of which is located at an end on the stacking tray side of the processing tray, the pushing member being arranged to allow the distal end to project in a direction of the stacking tray;

a pushing member driving mechanism that reciprocatingly drives the pushing member such that the distal end projects in the direction of the stacking tray and returns to the processing tray side after the projection; and a driving control mechanism that controls to drive the pushing member driving mechanism to perform a reciprocating operation for projecting, in a process of conveying the sheet(s) from the processing tray to the stacking tray with the conveying mechanism, the distal end of the pushing member to the stacking tray side to push a lower surface of the sheet(s) and returning the distal end to the processing tray side after the pushing, wherein the pushing member includes a frictional member at the distal end that pushes the lower surface of the sheet(s).

2. A sheet post-processing apparatus according to claim 1, wherein the conveying mechanism includes a discharge roller that conveys the sheet(s) to the stacking tray, and the pushing member is arranged further on a lower side than a sheet contact surface of the discharge roller in a state in which the distal end thereof is returned to the processing tray side.

3. A sheet post-processing apparatus according to claim 1, wherein a plurality of the pushing members are arranged in a width direction of the sheet(s).

4. A sheet post-processing apparatus according to claim 1, wherein the pushing member is formed of an elastically deformable bar-like material.

5. A sheet post-processing apparatus according to claim 1, wherein the conveying mechanism includes an ejector that pushes a trailing end of the sheet(s) aligned by the processing tray in the direction of the stacking tray.

6. A sheet post-processing apparatus according to claim 5, wherein the pushing member and the ejector are integrally formed, and a reciprocating motion of the pushing member and a reciprocating motion of the ejector synchronize with each other.

7. A sheet post-processing apparatus according to claim 5, wherein the pushing member is formed separately from the ejector and driven by a driving source different from that for the ejector.

8. A sheet post-processing apparatus comprising:

means for aligning stacked one or plural sheets;

sheet stacking means on which the sheet(s) aligned by the aligning means are stacked;

conveying means for conveying the sheet(s) aligned by the aligning means to the sheet stacking means;

pushing means, a distal end of which is located at an end on the sheet stacking means side of the sheet aligning means, the pushing means being arranged to allow the distal end to project in a direction of the sheet stacking means;

pushing member driving means for reciprocatingly driving the pushing means such that the distal end projects in the direction of the sheet stacking means and returns to the sheet aligning means side after the projection; and driving control means for controlling to drive the pushing member driving means to perform a reciprocating operation for projecting, in a process of conveying the sheet(s) from the sheet aligning means to the sheet stacking means with the conveying means, the distal end of the pushing means to the sheet stacking means side to push a lower surface of the sheet(s) and returning the distal end to the sheet aligning means side after the pushing, wherein the gushing means includes a frictional member at the distal end that pushes the lower surface of the sheet(s).

9. A sheet post-processing method comprising:

aligning stacked one or plural sheets with a processing tray;

conveying the aligned sheet(s) and stacking the sheet(s) on a stacking tray; and performing a reciprocating operation for projecting, in a process of conveying the sheet(s) from the processing tray to the stacking tray, a distal end of a pushing member to the stacking tray side to push a lower surface of the distal end of the sheet(s) and returning the distal end to the processing tray side after the pushing, wherein the pushing means includes a frictional member at the distal end that pushes the lower surface of the sheet(s).

10. A sheet post-processing apparatus comprising:

a processing tray that aligns stacked one or plural sheets;

a stacking tray on which the sheet(s) aligned by the processing tray is stacked;

a conveying mechanism that conveys the sheet(s) aligned by the processing tray to the stacking tray;

a pushing member, located at discharge side of the processing tray to project the sheets in contact with the lower surface of the sheet(s) in a direction of the stacking tray, the pushing member does not come into contact with the sheet when positioned on the processing tray side and the distal end of the pushing member projects to the stacking tray side and comes in contact with the lower surface of the sheet pushing up the sheet;

a pushing member driving mechanism that drives the pushing member;

a driving control mechanism that controls to drive the pushing member driving mechanism to perform a reciprocating operation, in a process of conveying the sheet(s) from the processing tray to the stacking tray with the conveying mechanism.

11. A sheet post-processing apparatus according to claim 10, wherein the conveying mechanism includes a discharge roller that conveys the sheet(s) to the stacking tray, and the pushing member is arranged further on a lower side than a sheet contact surface of the discharge roller in a state in which the distal end thereof is returned to the processing tray side.

12. A sheet post-processing apparatus according to claim 10, wherein a plurality of the pushing members are arranged in a width direction of the sheet(s).

13. A sheet post-processing apparatus according to claim 10, wherein the pushing member is formed of an elastically deformable bar-like material.

14. A sheet post-processing apparatus according to claim 10, wherein the conveying mechanism includes an ejector that pushes a trailing end of the sheet(s) aligned by the processing tray in the direction of the stacking tray.

15. A sheet post-processing apparatus according to claim 14, wherein the pushing member and the ejector are integrally formed, and a reciprocating motion of the pushing member and a reciprocating motion of the ejector synchronize with each other.

16. A sheet post-processing apparatus according to claim 14, wherein the pushing member is formed separately from the ejector and driven by a driving source different from that for the ejector.

* * * * *